United States Patent [19]

van Tilburg, deceased et al.

[11] 4,432,927

[45] Feb. 21, 1984

[54] CREPING MACHINE AND METHOD

[76] Inventors: Jan van Tilburg, deceased, late of London, England; by Yolande E. van Tilburg, administrator, 6 Clarendon Gardens, London W9 1A1, England

[21] Appl. No.: 243,945

[22] PCT Filed: Jun. 30, 1980

[86] PCT No.: PCT/GB80/00109

§ 371 Date: Jul. 22, 1981

§ 102(e) Date: Jul. 22, 1981

[87] PCT Pub. No.: WO81/00082

PCT Pub. Date: Jan. 22, 1981

[30] Foreign Application Priority Data

Jun. 28, 1979 [GB] United Kingdom ..... 7922445

[51] Int. Cl.[3] ..... B31F 1/14; D06C 21/00

[52] U.S. Cl. ..... 264/282; 26/18.6; 162/111; 162/280; 162/281

[58] Field of Search ..... 264/282, 283; 26/18.6; 162/111, 280, 281

[56] References Cited

U.S. PATENT DOCUMENTS

| | | | |
|---|---|---|---|
| 1,751,471 | 3/1930 | Campbell | 162/280 |
| 2,567,967 | 9/1951 | Rowe | 26/18.6 |
| 3,426,405 | 2/1969 | Walton | 26/18.6 |
| 4,078,958 | 3/1978 | Patin | 264/283 |
| 4,142,278 | 3/1979 | Walton et al. | 26/18.6 |

FOREIGN PATENT DOCUMENTS

| | | | |
|---|---|---|---|
| 8101426 | 5/1981 | United Kingdom | 26/18.6 |

*Primary Examiner*—Donald E. Czaja
*Assistant Examiner*—James C. Housel
*Attorney, Agent, or Firm*—Scully, Scott, Murphy & Presser

[57] ABSTRACT

A creping machine comprising a driven rotary carrier roll; a stationary blade assembly which is positioned to press sheet material into entrained engagement with the circumferential surface of the carrier roll and which includes a resilient spring blade projecting downstream from the immediately adjacent portion of the assembly; and a stationary retarder extending downstream from the circumferential surface of the carrier roll adjacent to the projecting resilient spring blade and over which the sheet material passes on disengagement from the said surface; the retarder having a transverse upstream facing wall extending downwardly from its upper surface whereby a cavity constituting a creping zone is defined upstream of the said wall and beneath the projecting resilient spring blade. Operation of the machine, which can in some cases be effected without a projecting blade causes a true creping action at wall. The machine and method disclosed allow fine microcrepe and good 2-way drape to be achieved (in paper, textiles, etc.) economically at a high throughput rate.

10 Claims, 7 Drawing Figures

CREPING MACHINE AND METHOD

This invention relates to the creping (especially microcreping) of sheet material and especially of fibrous sheet material e.g. paper. The invention involves a departure from prior microcreping apparatus and methods such as the commercial "MICREX" machine and process as taught, for example, in U.S. Pat. Nos. 3,260,778 and 3,426,405.

A cross-section of the treatment zone of such a prior machine is illustrated in simplified and schematic form in FIG. 1 of the accompanying drawings. The machine has a driven rotary roll 1, a retarder blade 2 with blade edge 3 and retarding working surface 9, and a covering resilient spring blade 4 projecting from a blade assembly 6. The roll rotates in the direction of the arrow. The sheet to be micro-creped is pressed onto the roll by means of blade assembly 5 via the blade assembly 6 and leaves at 7 after going through cavity 8 and between blades 2 and 4. The sheet itself is not shown in this Figure. The area inside the dotted rectangle of FIG. 1 is shown on a more enlarged scale in FIG. 2 of the accompanying drawings.

According to U.S. Pat. No. 3,260,778 (column 7, lines 42–66), the retarding working surface 9 is disposed with its edge 3 adjacent the roll 1, so that an acute angle $\alpha$ is included between the retarding surface 9 and the direction of movement of the portion of the roll surface passing under the retarder edge 3. The angle must, according to this U.S. patent, be acute, and not closely approach a right angle, as the latter would cause jamming of the machine. Moreover, according to this U.S. patent, the angle must be substantial, in order to create resistance forces and to obtain disengagement of the sheet material from the roll 1 without contact with the retarder edge 3.

Because of this requirement that the sheet material should not contact the retarder edge 3, a machine based on these U.S. patents is not so much a creping machine, but relies more on a stuffer box effect between blades 2 and 4.

The present invention, in contrast, obtains creping by purposely directing the sheet into impingement against a transverse upstream-facing wall of the retarder—which may be a blunt upstream edge 3 of the retarder or a step in its upper surface 9—the dimensions of the treatment cavity immediately upstream of the transverse wall being such that said impingement and creping occurs.

The present invention provides a creping machine comprising a driven rotary carrier roll; a stationary blade assembly which is positioned to press sheet material into entrained engagement with the circumferential surface of the carrier roll and which includes a resilient spring blade projecting downstream from the immediately adjacent portion of the assembly; and a stationary retarder extending downstream from the circumferential surface of the carrier roll adjacent to the projecting resilient spring blade and over which the sheet material passes on disengagement from the said surface; the retarder having a transverse upstream-facing wall extending downwardly from its upper surface whereby a cavity constituting a creping zone is defined upstream of the said wall and beneath the projecting resilient spring blade.

The said transverse upstream-facing wall may constitute the upstream extremity of the retarder, or an intermediate step interrupting the upper surface of the retarder. In the latter case, the retarder may be an integral body or a composite of a base member having a plate or blade secured to its upper face to provide the step.

Since the machine and method according to the invention involve a true creping action, rather than relying mainly on pressure and friction between blades 2 and 4 and the sheet material, they permit working at lower pressures and friction than necessary heretofore (thus satisfactory microcrepes have been obtained according to the invention, with paper about 0.1 mm thick, using a pressure as at P, FIG. 1, of less than 100 g/cm). Lower operating pressure and friction can have the advantage of less heat generation (avoiding problems when heatsensitive binders are used in the sheet), less dust formation, lower power consumption, or higher operating speed, giving a more uniform and predictable product with less deterioration and strength loss.

The resilient spring blade may terminate short of the transverse wall, or extend a distance downstream over the retarder beyond the transverse wall; in the latter case the said distance is preferable small, e.g. about 1 mm.

The included angle between the transverse wall and the carrier surface immediately upstream thereof (in the case where the wall is at the upstream extremity of the retarder), or that between the transverse wall and the retarder surface immediately upstream thereof (in the case where the wall is an intermediate step), is preferably from 60° to 120°, most preferably about 100°.

Free edges which may contact the sheet material—e.g. the downstream edge of the projecting resilient spring blade or the top edge of the transverse wall are preferably smoothed or rounded.

The retarder is suitably wedge-shaped, tapering upstream, e.g. at an included angle of 10° to 30°, though other included angles are possible.

The invention also provides a method of creping sheet material which comprises pressing the sheet material into entrained engagement with an advancing carrier surface, and disengaging the entrained sheet material from the advancing carrier surface at a stationary retarder extending downstream from the said surface, the advancing sheet material being creped by impingement against a transverse upstream-facing wall of the retarder—preferably whilst constraining the advancing sheet material under a resilient spring blade which extends downstream thereover at least partially to the transverse wall.

The invention is illustrated, by way of example only, in FIGS. 3 to 7 of the accompanying drawings, in which.

In the various Figures of the drawings, like parts are frequently accorded like reference numerals.

Figure 1:
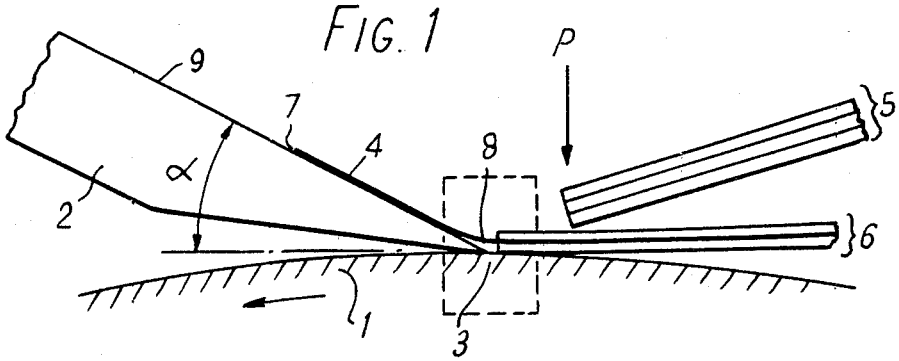
FIGS. 1 and 2 are similar views of prior machines.
Figure 2:
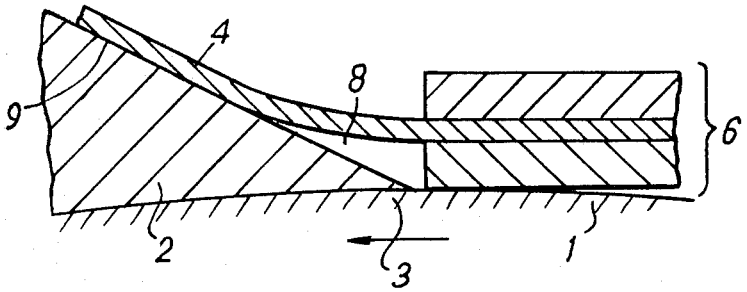
Figure 3:
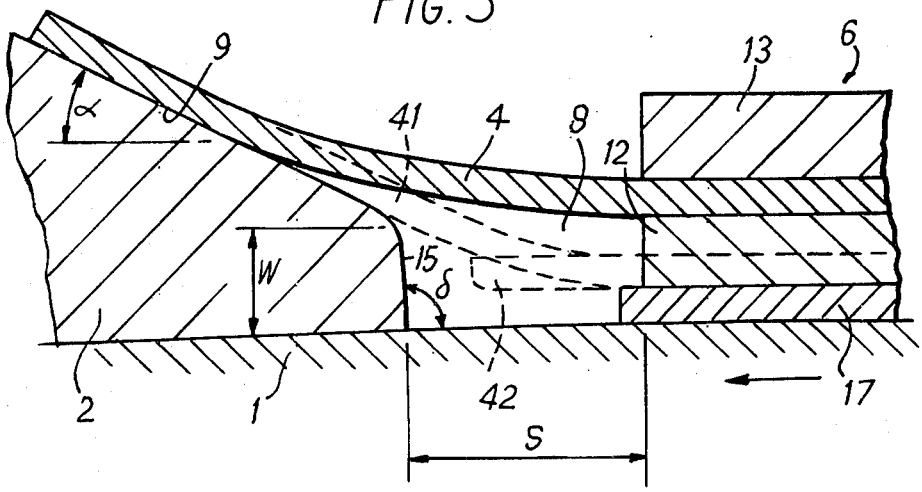
FIG. 3 is a schematic sectional view of the operative portion of one machine according to the invention.

FIG. 3 illustrates an embodiment of the invention employing a blunt-ended retarder 2 for microcreping sheet material 17 (e.g. paper) which is shown just entering the creping zone 8. Retarder 2 has an upstream extremity constituted by the transverse upstream-facing wall 15 extending downwardly from its upper surface 9. The blade assembly 6 has upper and lower blades 12, 13 sandwiching a resilient spring blade 4 which projects therefrom downstream over surface 9. Sheet 17 is pressed into entrained engagement with roll surface 1 (driven in the direction of the arrow) by pressure applied via blade assembly 6 by another blade assembly (not shown) similar to assembly 5 of FIG. 1. In the illustrated FIG. 3 embodiment, for microcreping of paper 17 of about 0.1 mm. gauge, the height w of wall 15 may for example be from 0.1 to 0.3 mm. with the angle δ at 60° to 120° e.g. about 100° and the distance s about 0.75 mm. It is preferred that blade 12 should be thinner than the corresponding blade conventionally employed in "Micrex" machines, e.g. 0.075 or 0.1 mm. as compared to 0.25 mm. Satisfactory creping may also be obtained with the FIG. 3 arrangement from which blade 12 is omitted, i.e. with blade 4 in the position 41 shown in dotted lines.

The sheet 17 carried by roll 1 into the creping zone 8 collides with wall 15, and the resulting microcreped sheet exits from the zone 8 between surface 9 and the under surface of blade 4. Because of the relatively light pressure which can be employed, the illustrated machine can be run at higher speeds than normally possible for conventional "MICREX" machines, enhancing the creping on collision with wall 15 and in some instances permitting omission of blade 4, or use of a blade 4 which as indicated at 42 in dotted lines projects only partially towards wall 15. In every case, the lower free edge of blade 4 is preferably rounded.

In the illustrated and described FIG. 3 embodiments the angle α is suitably relatively low, e.g. 10 to 30 degrees, but is not critical for effective creping; for example, when blade 4 is employed in disposition 42, α may be equal to δ.

In all of the FIG. 3 embodiments, the top edge of wall 15 where it meets surface 9 is preferably rounded, or at least not so sharp or abrupt as to damage the sheet under treatment. Where there is overlap between blade 4 and surface 9, it is preferably relatively short, e.g. about 1 mm., as opposed to the 7 to 9 mm. conventionally employed on "MICREX" machines, this applying also to other embodiments of the invention in general. It can likewise be of advantage in all embodiments of the invention employing a resilient spring blade 4, to use a pack of very thin superposed blades of a given total thickness instead of a single blade of the said given thickness, the pack of thinner blades being more resilient.

Figure 4:
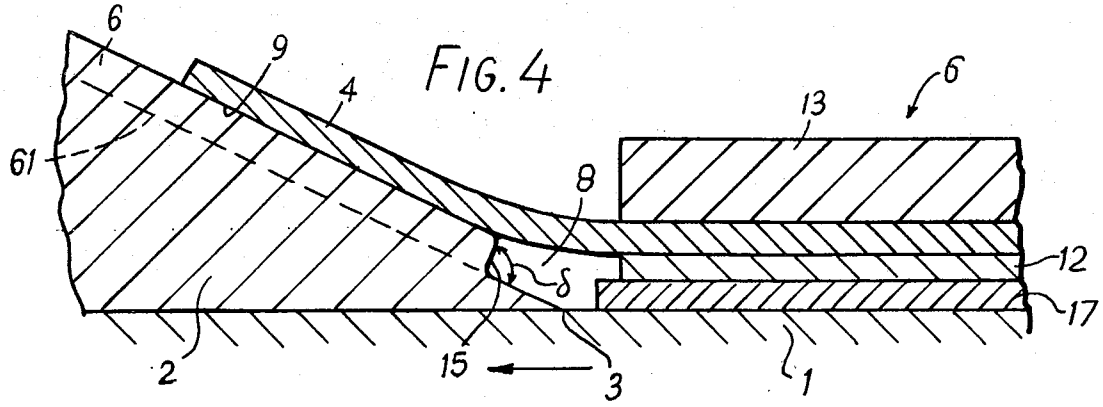
FIGS. 4, 5, 6 and 7 are similar views of respective further machines according to the invention.

FIG. 4 illustrates a different type of embodiment according to the invention in which the transverse wall 15 forms a step interrupting the upper surface 9 of retarder 2 downstream from its upstream extremity 3. Retarder 2 may be an integral body as shown in full lines, or could be a combination of a plain wedge having an upper surface 61 to which is secured a plate or blade 62 whose upstream end provides the transverse wall 15; in the latter case, plate or blade 62 is preferably adjustable in the upstream and downstream directions to vary the creping zone 8 according to the conditions and sheet material being employed. The angle δ is preferably about 100°, and the various preferred features and modifications mentioned above in connection with the FIG. 3 embodiments—e.g. positioning and extent (or absence) of resilient spring blade 4, replacement of single blade 4 by thinner blades of the same total thickness, nature (or absence) of blade 12, height of wall 15 and the rounding off of its edge with surface 9, etc, apply equally to the FIG. 4 embodiment. The FIG. 4 embodiment also operates in similar fashion to those of FIG. 3, with the sheet 17 impinging against wall 15 and the resulting microcreped product formed in zone 8 exiting over surface 9.

Figure 5:
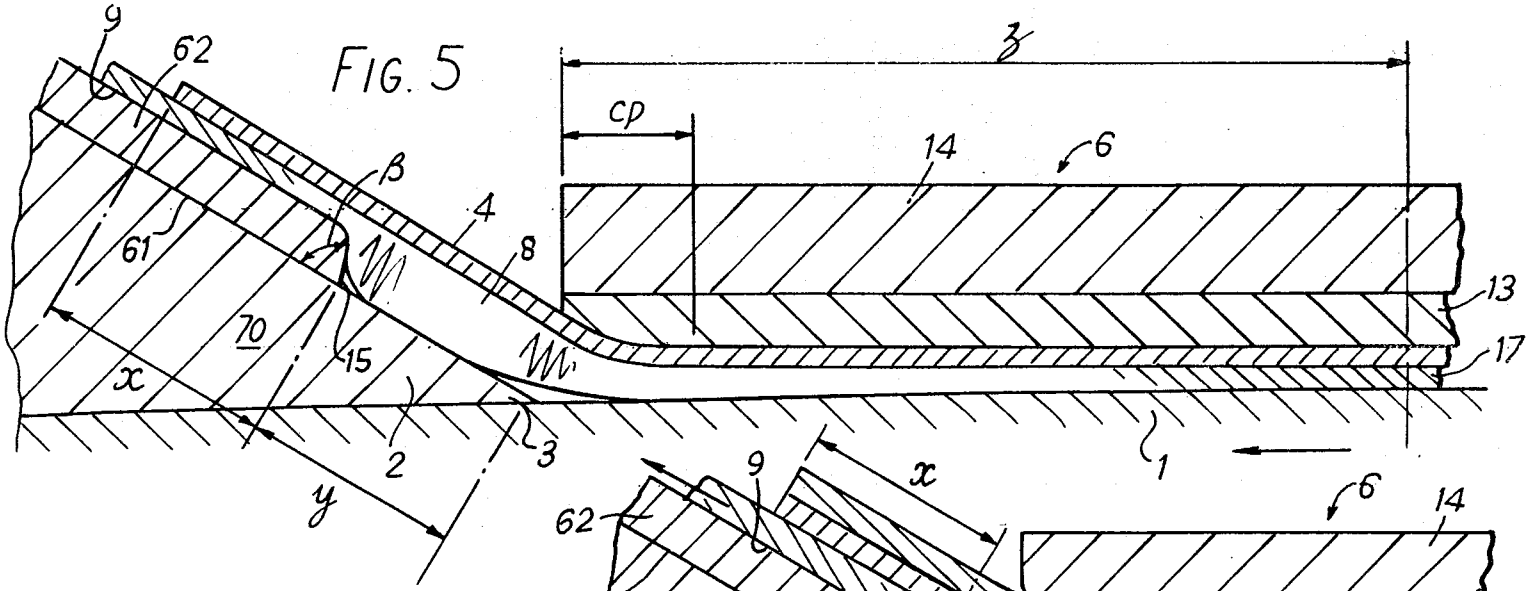

FIG. 5 is a sectional view, similar to that of FIG. 4 but on a larger scale, of another stepped retarder embodiment according to the invention. In this case retarder 2 is made up of a conventional wedge shaped retarder member 70 having secured to its upper face 61 a plate 62 providing a transverse wall 15 disposed downstream of the upstream extremity 3 of the retarder. The angle β is preferably about 80°, and the upper edge of wall 15 is again preferably rounded where it joins upper face 9. Plate 62 can be adhered to wedge 70, but is preferably secured thereto so as to be adjustable in the upstream and downstream directions. In this particular embodiment, the plate 12 of assembly 6 is omitted, and a further blade 14 is disposed over blade 13. Blade 13 is preferably rounded at its lower downstream edge as indicated, and is preferably secured to resilient spring blade 4 where they overlap except over the curved portion CP. For the microcreping of paper of about 0.1 mm. gauge, for example, the distances x and y may each be about 1 mm; the height of wall 15 from 0.1 to 0.3 mm; and the distance z, measured downstream from where pressure P is applied by a further blade assembly (not shown) as at 5 in FIG. 1, about 4 mm; plate 62 may be about 0.25 mm. thick, and blades 4, 13 and 14 respectively about 0.1, 0.25, and 0.5 mm. thick. The lower downstream edge of blade 4 is preferably smoothed down or rounded (not shown). If greater pressure is required, then a further blade or blades can be disposed between blades 13 and 14 or above blade 14. The FIG. 5 embodiment operates in the same manner as described with reference to FIGS. 3 and 4; in FIG. 5, the conformation adopted by the paper 17 in passing into through and from creping zone 8 is indicated only schematically.

Figure 6:
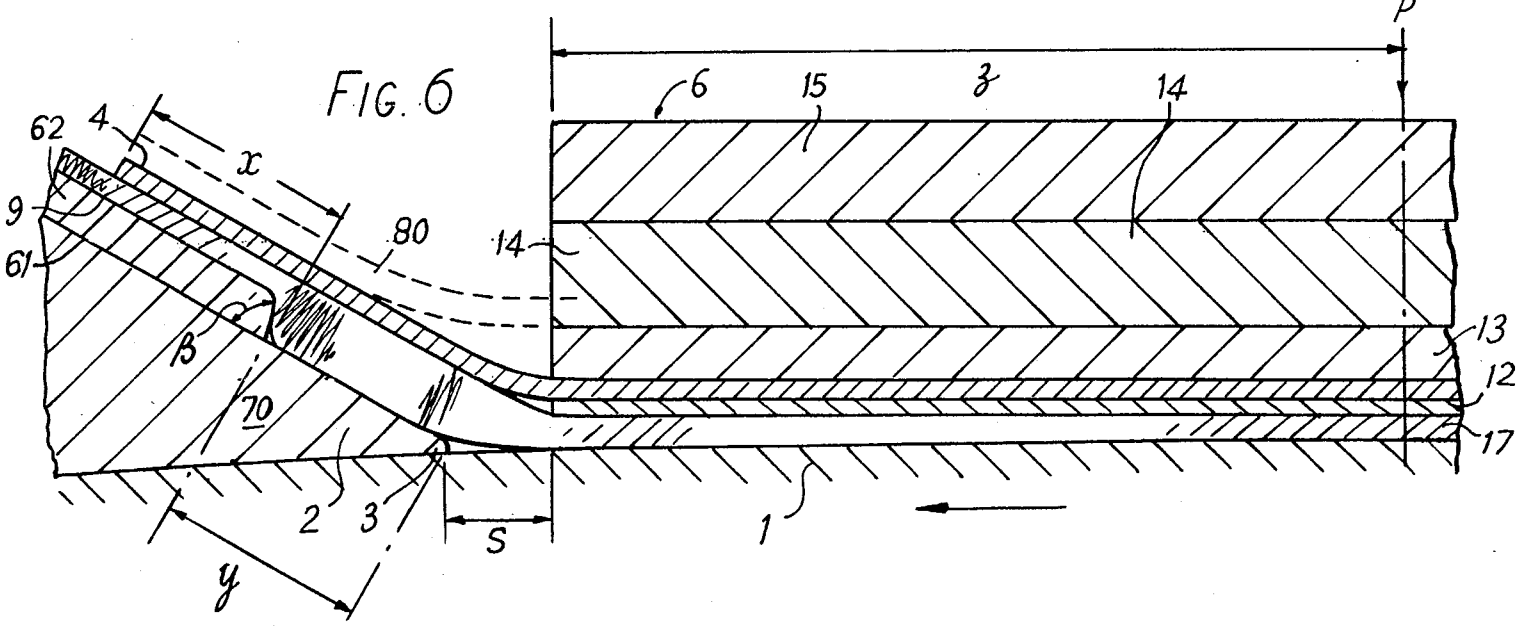

FIG. 6 shows a slightly modified arrangement according to the invention, which includes a thin blade 12 beneath resilient spring blade 4, the latter being loosely inserted in assembly 6 and retained in position by the pressure P applied. Angle β is suitably 60° to 120°, preferably about 80°. Plate 62 and blades 4, 13 and 14 may be of the same thickness as mentioned for FIG. 5, and blades 12 and 15 may be 0.075 mm and 0.5 mm thick respectively. For microcreping 0.1 mm gauge paper, the transverse wall height and the values of x, y, and z may be as for FIG. 5, s suitably being about 0.5 mm. The downstream lower edges of blades 4 and 12 are smoothed or rounded as usual, as is the top edge of wall 15. If more pressure is required a further blade may be inserted in assemble 6, e.g. as indicated in dotted lines at 80.

Figure 7:
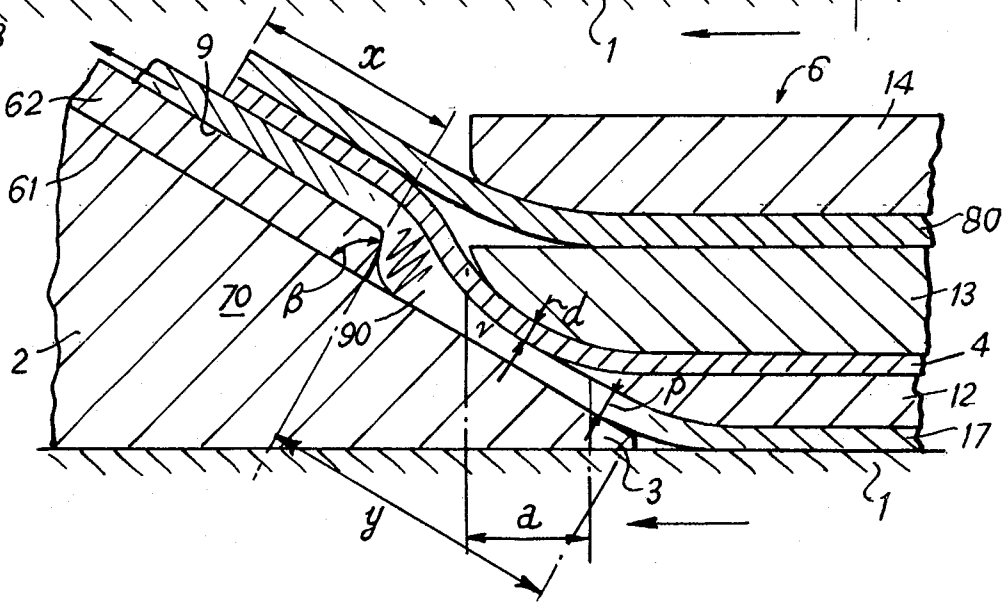

A currently preferred embodiment of the same generaly type is shown in FIG. 7, with blades 12, 13 and 14 arranged in echelon as indicated and blade 4 (smooth or rounded at its downstream lower edge) loosely inserted and retained in assembly 6 as in FIG. 6. Blade 80 is optional, and when used may for example be about 0.15 mm thick. Blades 4, 13 and 14 and plate 62 may be of the same thickness as in FIGS. 5 and 6, blade 12 suitably being 0.25 mm thick. The included angle of wedge 70 is preferably about 30°, and p is preferably a little larger than d. For microcreping 0.1 mm. gauge paper, the transverse wall height and the value of x are suitably the same as mentioned for FIGS. 5 and 6, but y is preferably about 1.5 mm., a suitable distance being about 0.6 mm. Satisfactory high-speed operation is also possible with no overlap between blade 4 and plate 62, e.g. with blade 4 terminating at position 90.

The disposition and dimensions of the various machine parts, and the operating conditions (machine speed, pressure) to give best creping results for a given sheet material are readily ascertained by trial and adjustment, and the numerical detail quoted above for illustrated embodiments is not critical. Thus trial runs on 0.1 mm gauge paper with a machine as illustrated in FIG. 7, but with blade 80 omitted and using a blade 4 of 0.05 mm thickness extending only to position 90, gave at a pressure of 40 g/cm$^2$ a very finely creped product having good drape in and across the machine direction; in similar runs but with plate 62 omitted, the upstream end 3 of retarder 2 blunted to provide the upstream-facing transverse wall (1–2 mm high), and blade 4 terminating upstream of position 90 (projecting only slightly from blade 12), substantially the same results were obtained. In comparison, with the same paper, treatment in a conventional "MICREX" manner—plate 62 omitted, blades 4 and 80 of 0.075 mm and 0.1 mm thickness respectively, blade 4 projecting 7 mm. beyond blade 13, and retarder extremity 3 sharp—gave an appreciably coarser crepe and poorer drape, the drape across the machine direction being substantially the same as that of the untreated paper.

When a blade 12 is used in machines according to the invention it need not, as is normally recommended for the "MICREX" process, have a lubricant coating e.g. of polyfluorocarbon resin, this being due to the lower pressure and friction generally employed in operating according to the invention; this can further decrease the operating temperature compared to that in the "MICREX" process. Further, since the invention does not rely mainly on a stuffer box action, the operating surface of the retarder is preferably smooth rather than rough and highfriction as in conventional "MICREX" machines.

The invention has been described above mainly in terms of paper, but is applicable to other sheet material which will crepe, especially fibrous sheet such as woven and non-woven textiles.

I claim:

1. A creping machine for high speed microcreping sheet material, said machine comprising:

(a) a single carrier roll which is driven, said roll having a circumferential surface for advancing the sheet material;

(b) a stationary blade assembly positioned to press sheet material into entrained engagement with the circumferential surface of the carrier roll;

(c) a stationary retarder mounted downstream from a point of contact with the circumferential surface of the carrier roll, said retarder removing said sheet material from its entrained engagement with said carrier roll, said retarder having a discharge plane over which the sheet material passes after disengagement from said circumferential surface;

(d) a single transverse upstream facing wall, said wall defining an angle of 60° to 120° from the discharge plane of said retarder;

(e) a resilient spring blade mounted in said stationary blade assembly, said spring blade projecting downstream from said assembly at least as far as said upstanding wall;

whereby said roll, said wall and said spring blade define a creping zone therebetween for microcreping sheet material.

2. A creping machine according to claim 1 wherein the transverse upstream-facing wall is at the upstream extremity of the retarder.

3. A creping machine according to claim 1 wherein the transverse upstream-facing wall constitutes an intermediate step interrupting the upper surface of the retarder downstream from its upstream extremity.

4. A creping machine according to claim 3 wherein the retarder comprises a composite of a base member having a plate or blade to provide the said step.

5. A creping machine according to claim 1 or 2 or 3 or 4 wherein the angle of said wall is about 100°.

6. A creping machine according to any of claims 1 or 2 or 3 or 4 wherein at least one of the downstream lower edge of the projecting resilient spring blade and the top edge of the transverse upstream-facing wall is smoothed or rounded.

7. A creping machine according to any of claims 1 or 2 or 3 or 4 wherein the projecting resilient spring blade terminates downstream at a position within 1 mm of a region extending between a location upstream of the transverse wall and a location downstream of the transverse wall.

8. A creping machine according to claim 1 or 2 or 3 or 4 wherein the upstanding wall extends upwardly across the flow path a distance of 1 to 3 times the thickness of the material to be creped.

9. A creping machine according to claim 1 or 2 or 3 or 4 wherein the projecting resiliant spring blade includes a pair of spring blades which extend downstream over the upstanding wall a distance substantially equal to the height of the wall.

10. A method of microcreping a sheet material, said method comprising the steps of:

(a) pressing a sheet material into entrained engagement with a single advancing circumferential carrier surface;

(b) disengaging the entrained sheet material from the advancing carrier surface with a stationary retarder, said retarder extending downstream from a tangental point of engagement on said circumferential surface;

(c) impinging said sheet material against an upstanding transverse wall in a confined creping zone;

(d) confining said sheet material with a resilient spring blade mounted over the creping zone;

(e) removing the creped material from the creping zone along a plane or retarding surface, said surface being aligned 60° to 120° from said transverse wall.

* * * * *